US005634693A

United States Patent [19]

Heuvelman

[11] Patent Number: 5,634,693

[45] Date of Patent: Jun. 3, 1997

[54] APPARATUS AND METHOD FOR REJUVENATION OF A ROTARY SCRUBBING BRUSH

[76] Inventor: George M. Heuvelman, P.O. Box 544, Burlington, Ill. 60109

[21] Appl. No.: 477,411

[22] Filed: Jun. 7, 1995

[51] Int. Cl.[6] ..... A46B 17/02

[52] U.S. Cl. ..... 300/21; 15/1; 15/257.01; 29/240; 29/402.05

[58] Field of Search ..... 15/257.01, 180, 15/1; 300/8, 11, 21; 29/240, 402.05

[56] References Cited

U.S. PATENT DOCUMENTS 5,042,107 8/1991 Gregory et al. ..... 15/257.01

FOREIGN PATENT DOCUMENTS 193581 1/1938 Switzerland ..... 15/257.01

*Primary Examiner*—David Scherbel
*Assistant Examiner*—Randall E. Chin
*Attorney, Agent, or Firm*—Mathew R. P. Perrone, Jr.

[57] ABSTRACT

A rotary scrubbing brush employed to clean carpets and floors is rejuvenated by straightening of the brush bristles after they have been bent or flexed. To straighten and or reverse the direction of worn and or bent brush bristles of a rotary carpet or a floor scrubbing brush lengthens the life of the brush.

13 Claims, 9 Drawing Sheets

APPARATUS AND METHOD FOR REJUVENATION OF A ROTARY SCRUBBING BRUSH

This invention relates to a rotary scrubbing brush employed to clean carpets and floors, and more specifically, to an apparatus and method for rejuvenation of a brush by straightening of the brush bristles after the bristles have been bent or flexed in use on a rotary floor machine.

BACKGROUND OF THE INVENTION

Rotary scrubbing brushes are customarily used on a machine for carpet scrubbing, floor scrubbing and other hard surface scrubbing and cleaning. With a machine using this rotary brush, a floor or other hard surface may be cleaned in an efficient manner. Mounted on such a machine for the direct surface or other floor contact is a rotary brush.

Rotary scrubbing brushes are used for carpet scrubbing, and other hard surface scrubbing and cleaning. With repeated use, the brush fibers tend to flex and bend thereby significantly reducing its effectiveness as a scrubbing implement.

The rotary brush serves well for cleaning. A general structure of the brush can be found in U.S. Pat. No. 5,050,262 to Terrance J. Malish. Many other rotary brushes are known to be suitable for use on the machine.

The brush is mounted on the base of the machine in contact with the floor. The machine provides the power to rotate the brush. Customarily in the industry the brush rotates in a clockwise position. With this use, the brushes can be permanently bent in one direction causing the brush to become ineffective as a scrubbing tool. One machine on which the rotary brushes are used is described in U.S. Pat. No. 5,261,140 to Thomas A. Szymanski.

Typically, machines used in the industry have the brushes rotating in a clockwise direction as one looks down on the top of the machine. Such rotation forces the brush in counter clockwise direction. When the bristles of the brush tend to stay in that counterclockwise direction, the brush loses its effectiveness as a cleaning agent and must be replaced at considerable expense.

This type of machine, with the rotary brush attached thereto, requires a certain degree of expertise to operate. Due to the brush rotation lifting up on the handle causes the machine to move to the right. Pushing down on the handle causes the machine to the left. The forward motion is accomplished by placing weight on the right hand side of the handle. The rearward motion is accomplished by placing weight on the left hand side of the handle. It requires a reasonable amount of skill to direct the machine using the rotary scrubbing brush in the appropriate manner.

While it is possible to incorporate a reversing mechanism on the machine, and avoid having the brush move in one direction entirely, such a reversing mechanism causes too much confusion in the adjustment of how to handle the machine for the operator. The standard procedures of handling and operating are completely reversed.

Also, it is somewhat difficult to examine the brush in use and make the appropriate reversal at the desired time. It is clearly necessary to be able to efficiently examine the brush and reverse the machine rotation thereof at the appropriate time.

As is clear to one skilled in this art, the brush bristles are most effective when they are substantially perpendicular to the brush base. Use sets the bristles away from that perpendicular status. A desired brush treatment can correct this problem. However, no such device is available.

What is desired is a device which can apply pressure on the bristles and reverse the bristles at the convenience of the operator. If such a reversal of the bristles can be accomplished, the life of the brush can be increased by a factor of at least two (2), if not four (4). However, there is no known apparatus or method for achieving this desired result.

SUMMARY OF THE INVENTION

Therefore, among the many objectives of this invention is to provide an apparatus for reversing the position of bristles of a rotary brush.

A further objective of this invention is to provide an apparatus to increase the useful life of a rotary brush.

A still further objective of this invention is to provide an apparatus to simplify the operation of a machine on which a rotary brush is used.

Yet a further objective of this invention is to provide an apparatus to eliminate the need for a reversing mechanism on a machine using a rotary brush.

Also an objective of this invention is to provide an apparatus for applying pressure to the bristles of a rotary brush.

Another objective of this invention is to provide a apparatus for reversing the bristles of a used brush.

Yet another objective of this invention is to provide a device for holding the bristles of a brush in a desired position.

Still another objective of this invention is to provide a device for increasing the life of a rotary brush.

A further objective of this invention is to provide a device to reset the bristles of a rotary brush to perpendicular relationship with the brush base.

A still further objective of this invention is to provide a method to rejuvenate a rotary brush.

These and other objectives of the invention (which other objectives become clear by consideration of the specification, claims and drawings as a whole) are met by providing a device for reversing the direction of the rotation of the brush while simultaneously compressing the brush's bristles against a frictional surface causing the bristles to bend in the opposite direction than that, for which the brush is designed.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
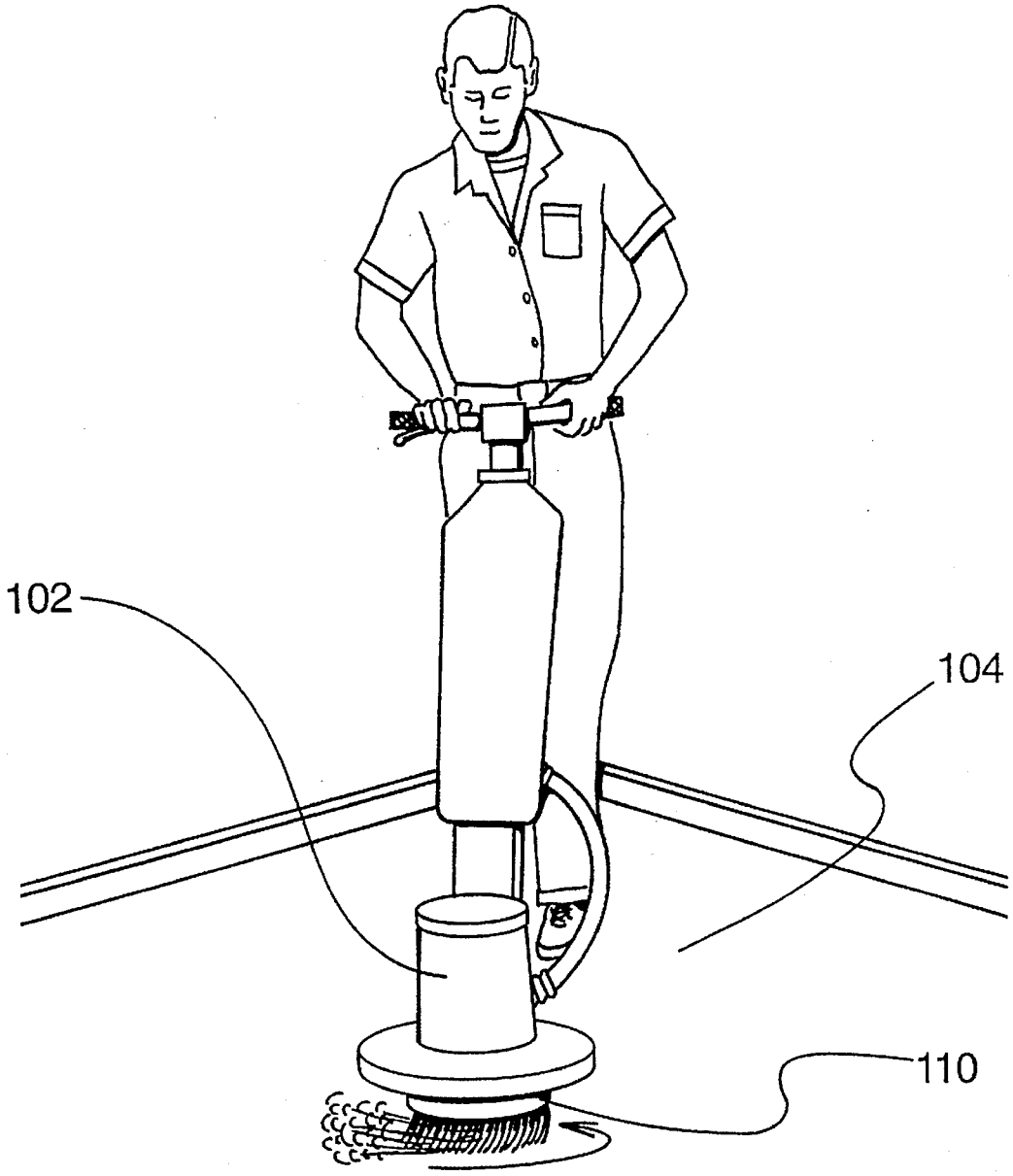
FIG. 1 depicts a rotary brush 110 in use.

This invention relates to rotary scrubbing brushes employed to clean carpets and floors, and more specifically, to the rejuvenation and straightening of the brush bristles after they have been bent or flexed. To straighten and or reverse the direction of worn and or bent brush bristles of a rotary carpet or a floor scrubbing brush lengthens the life of the brush. Without this device, the brush bristles can become permanently bent, thus rendering the scrub brush ineffective as a scrubbing tool.

The device of this invention provides a fixed or mobile instrument to reverse the direction of the rotation of the brush while simultaneously compressing the brush's bristles against a frictional surface. This procedure causes the bristles of the brush to bend in the opposite direction than that which the brush was designed to bend after a period of use.

The body of the device is generally shaped similarly to the transmission gear of a rotary floor machine. The invention has several very distinct differences, however, including: 1) it rotates rotary scrub brushes in the reverse direction than which they were designed, 2) the invention mounts on a fixed center axle that employs right hand threads to compress the scrub brush to a frictional surface as it is rotated in a clockwise direction while simultaneously compressing the brush bristles, 3) the protrusions do not lock up as with a transmission gear on the rotary scrub machine, 4) it is manually operated and can be mounted in a fixed position, or it can be adjusted to provide mobility.

The purpose of the invention requires it to rotate the scrub brush in the reverse direction than that with which it is intended to rotate while in use, so it does not employ the same rotational compression as the transmission gear of a floor scrubbing machine. The transmission gear's sliding compression protrusions cause the transmission gear at the bottom of the rotary floor scrubbing machine and the clutch plate to "lock up" as a result of the clockwise rotation of the machine and the locking surface of the engaged clutch plate. The clutch plate was designed to be engaged and rotated in one direction.

This invention, however, is a completely independent device from the rotary floor machine engaging the clutch plate of the scrub brush with protrusions that are fixed and do not "lock up" to the clutch plate, but instead penetrate the clutch plate. Then when force is applied to the handle in a clockwise direction that is great enough to cause it to rotate against a frictional surface, that movement causes the individual brush bristle filaments to bend in the reverse direction to that which it was intended. Simultaneously, the brush bristles are compressed against a frictional surface so as to cause the flex in the opposite direction.

While it not desired to be bound by any particular structure, the device preferably has a handle of up to 80 centimeters long. The handle varies with the size of the rotary brush that has been engaged, that is employed to rotate the scrub brush in a clockwise direction which is opposite to that with which it was intended to turn. As the brush is being manually rotated, the center axle of the invention includes a mounting screw for securing purposes.

The material composition of the primary device is not significant so long as the material used is of sufficient structural integrity such that when a force is applied to the handle, it has the ability to perform as it was intended. A preferred material is a steel plate up to about one centimeter thick.

In fact, the material composition of any part of this device is not significant so long as the material used is of sufficient structural integrity such that when a force is a part thereof, it has the ability to perform as it was intended. Wood, steel, metal or plastic may be appropriate materials as long as the strength is there.

The frictional surface can be made of a common red buffing pad that is used when performing floor maintenance buffing and cleaning services. The frictional surface preferably has a diameter larger than the size of the brush being treated and up to about 80 centimeters. It is attached and centered to a flat surface with staples or any other suitable securing device.

The standard rotary brush includes a mounting board having a clutch plate on one side thereof and the bristles on the other side thereof. The mounting board permits the brush to lock onto the power machine. The structure of the mounting board or plate is useful for rejuvenating the brush after use.

Thus, the friction plate is mounted on a board. The bristles of the brush are placed on the friction plate. A clamp is placed on top of the brush to engage the plate. The clamp is rotated in a reverse direction of the bristles until the bristles are straight or slightly reversed. The brush bristle side can be placed on a friction surface and the brush rotated in a counter-clockwise manner until the brushes are straight or a little bit beyond that point.

The clamp is then locked in place with either a bolt secured to the plate or a plate followed by a bolt. With this rotation and the locking, the brush is held in the desired position until the bristles dry. After the brush is dried with its bristles held in the desired position, it is then ready for reuse. The straightened bristles provide for a brush to have a much longer life than a brush that is never straightened.

As indicated, the brush bristles are most effective when they are substantially perpendicular to the brush base. Use sets the bristles away from that perpendicular status. A flexible compression ring applied around the bristles while the brush is in the brush rejuvenating apparatus assists in the return of the bristles to the vertical.

Referring now to FIG. 1, a power machine 102 has a brush 110 secured thereto in operation. The power machine 102 is typically a carpet shampooer power machine 102 being applied to carpet 104. The carpet brush 110 is secured to the machine 102. The carpet shampoo machine 102 is maneuvered by an operator 106.

Figure 2:
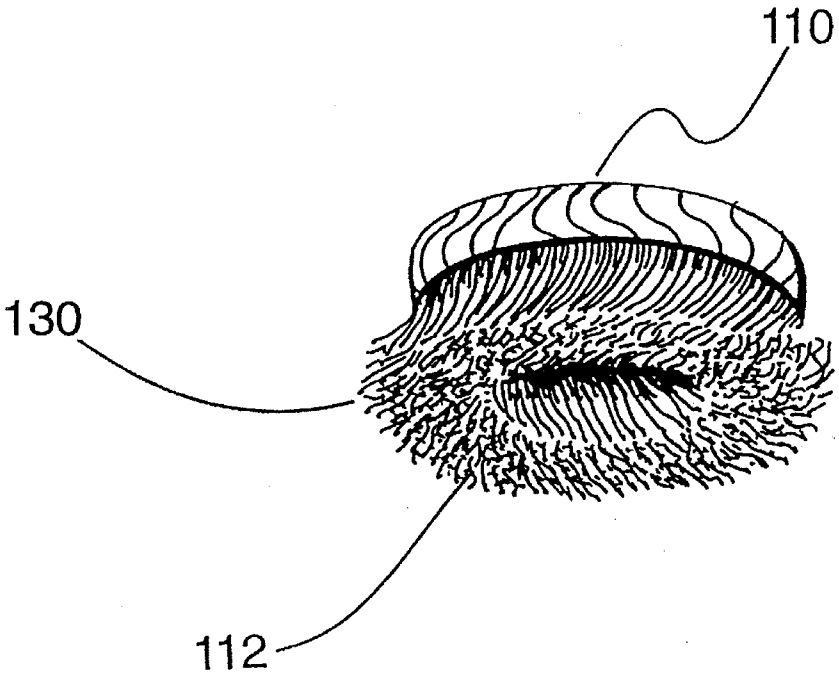
FIG. 2 depicts a rotary brush 110 in a used condition 112.

Referring now to FIG. 2, brush 110 is depicted in a used condition 112. The bristles 130 are forced in a clockwise position (used condition 112) due to the counter clockwise rotation of the carpet shampoo machine 102. With the bristles 130 in the counter clockwise position, the efficiency of the brush 110 becomes greatly reduced.

Figure 3:
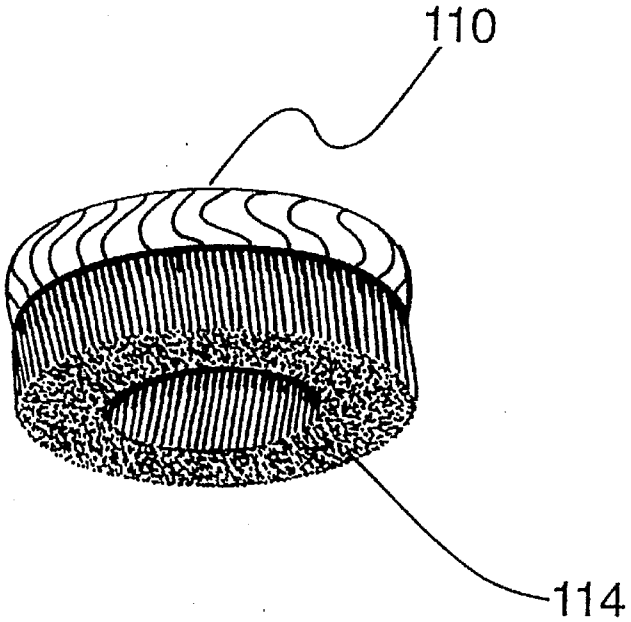
FIG. 3 depicts a rotary brush 110 in a rejuvenated condition 114.

FIG. 3, depicts brush 110 after treatment of bristles 130 by the method and apparatus disclosed in the subsequent figures. Bristles 130 are straightened or moved little behind the rotation vertical point and held in that position for rejuvenated condition 114. Then the brush 110 is dried.

Figure 4:
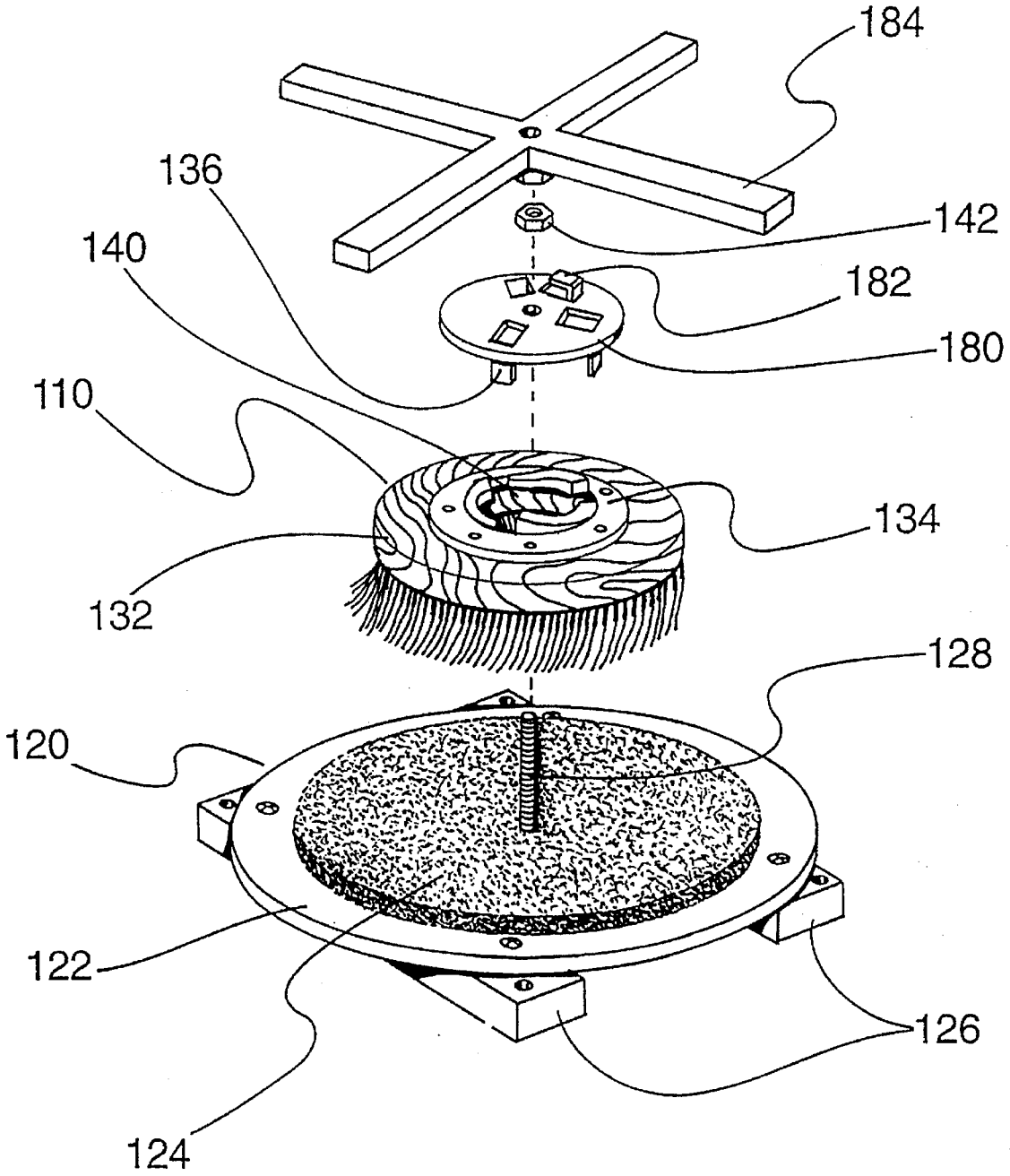
FIG. 4 depicts a perspective, exploded view of brush rejuvenating apparatus 100.
Figure 6:
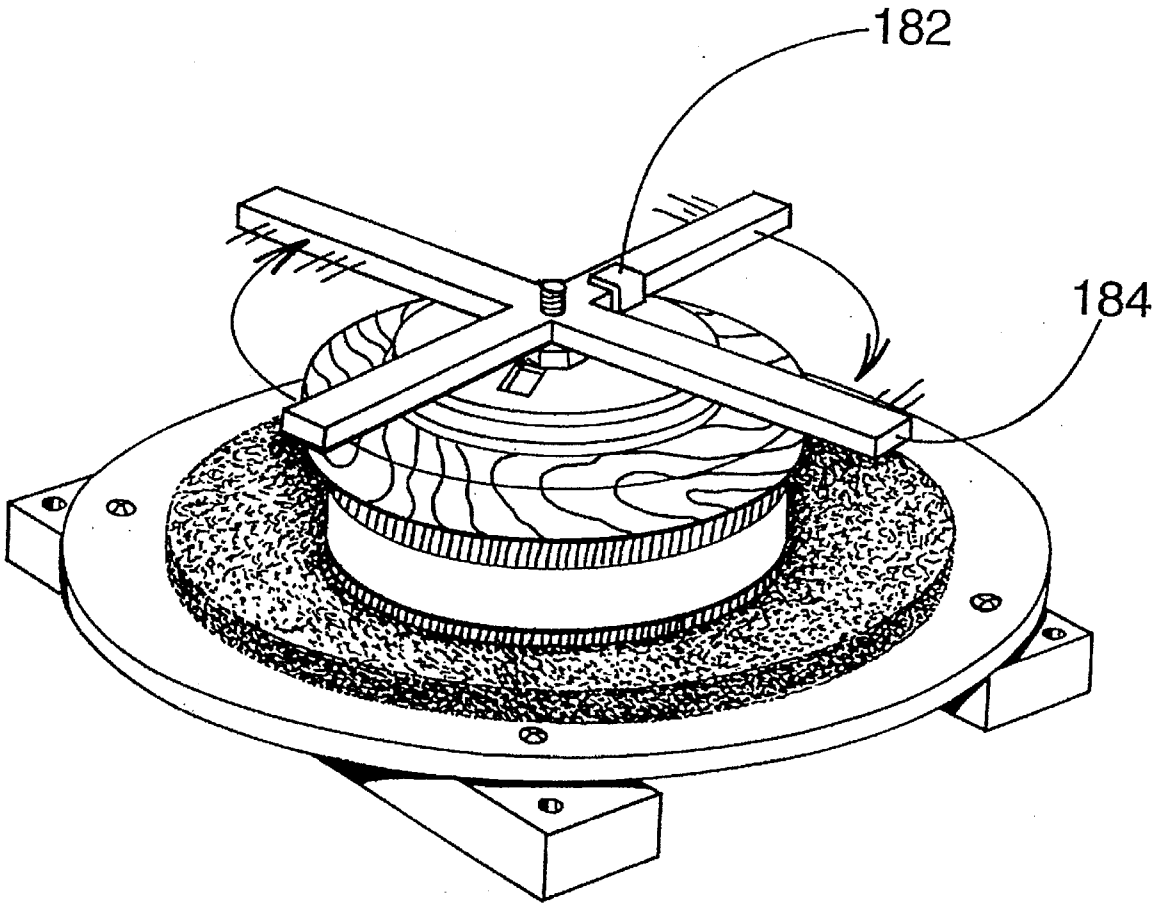
FIG. 6 depicts a perspective, top, assembled view of brush rejuvenating apparatus 100.

Referring now to FIG. 4 and FIG. 6, the brush rejuvenating apparatus 100 includes a friction plate 120. The friction plate 120 has a friction base 122 with a frictional surface 124 thereon. The frictional surface 124 is capable of contacting bristles 130 of brush 110 and providing sufficient force to straighten the bristles 130.

Figure 5:
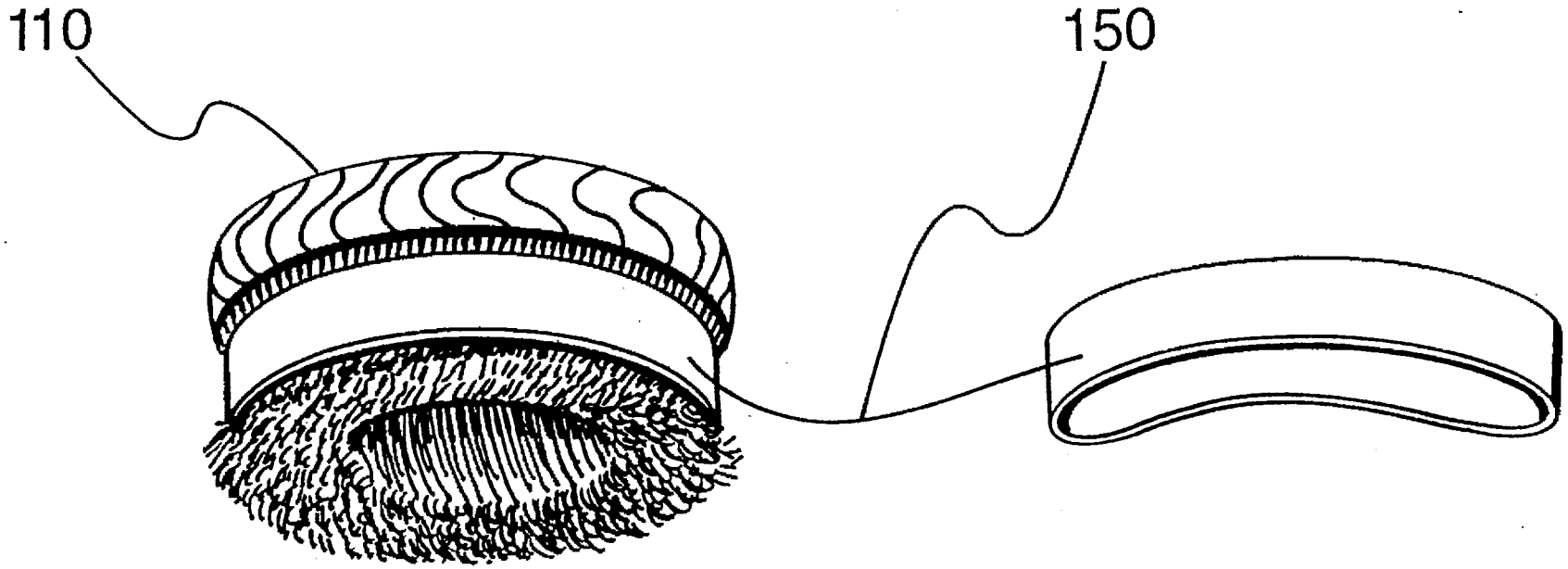
FIG. 5 depicts a perspective, exploded view of rubber belt 150 for brush 110.

As above described, FIG. 5 depicts a perspective, exploded view of rubber belt 150 for brush 110. If desired, rubber belt 150 may be placed over the outside of the bristles to hold the bristles in better position.

Figure 7:
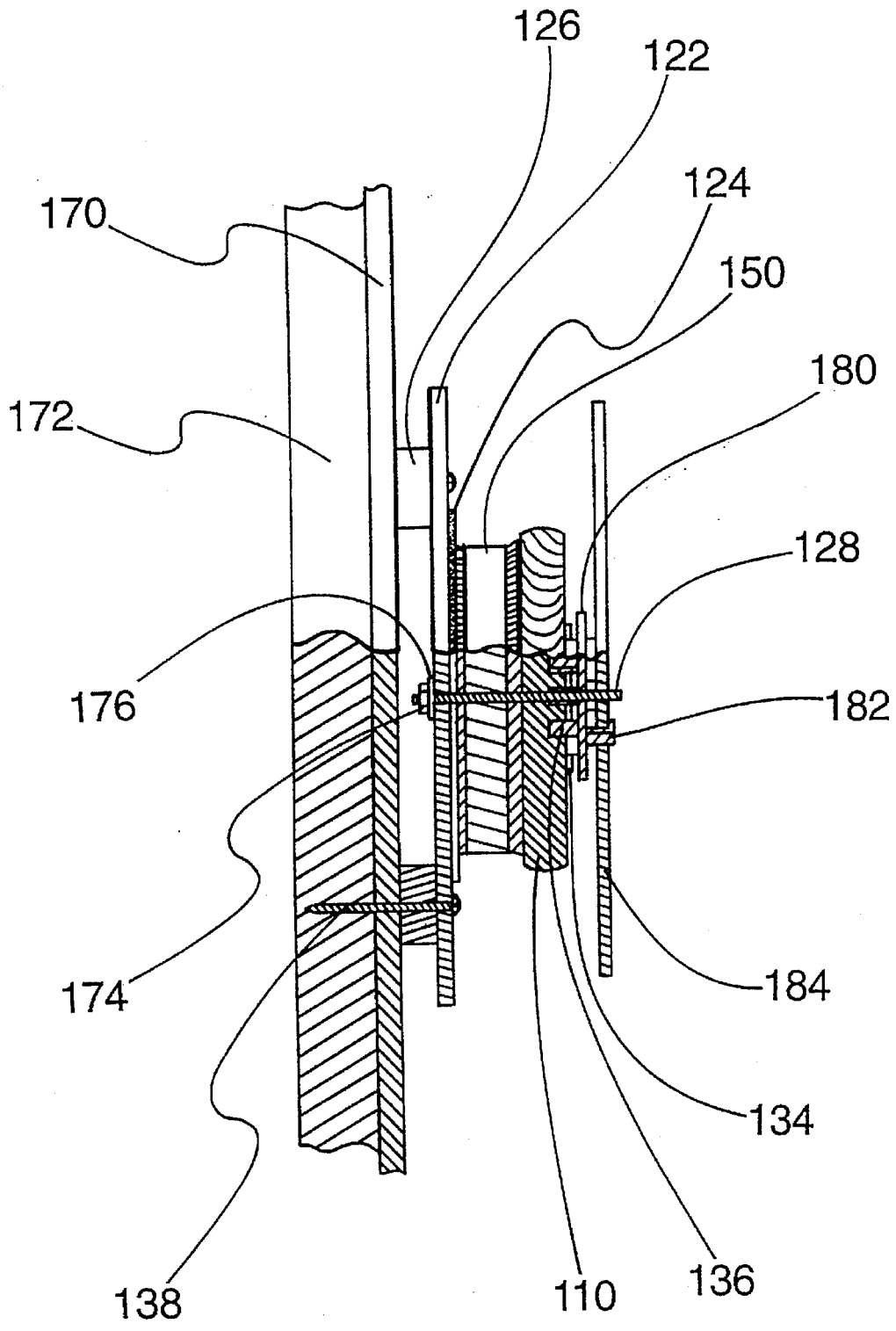
FIG. 7 depicts a side, partially cross-sectioned view of brush rejuvenating apparatus 100.
Figure 8:
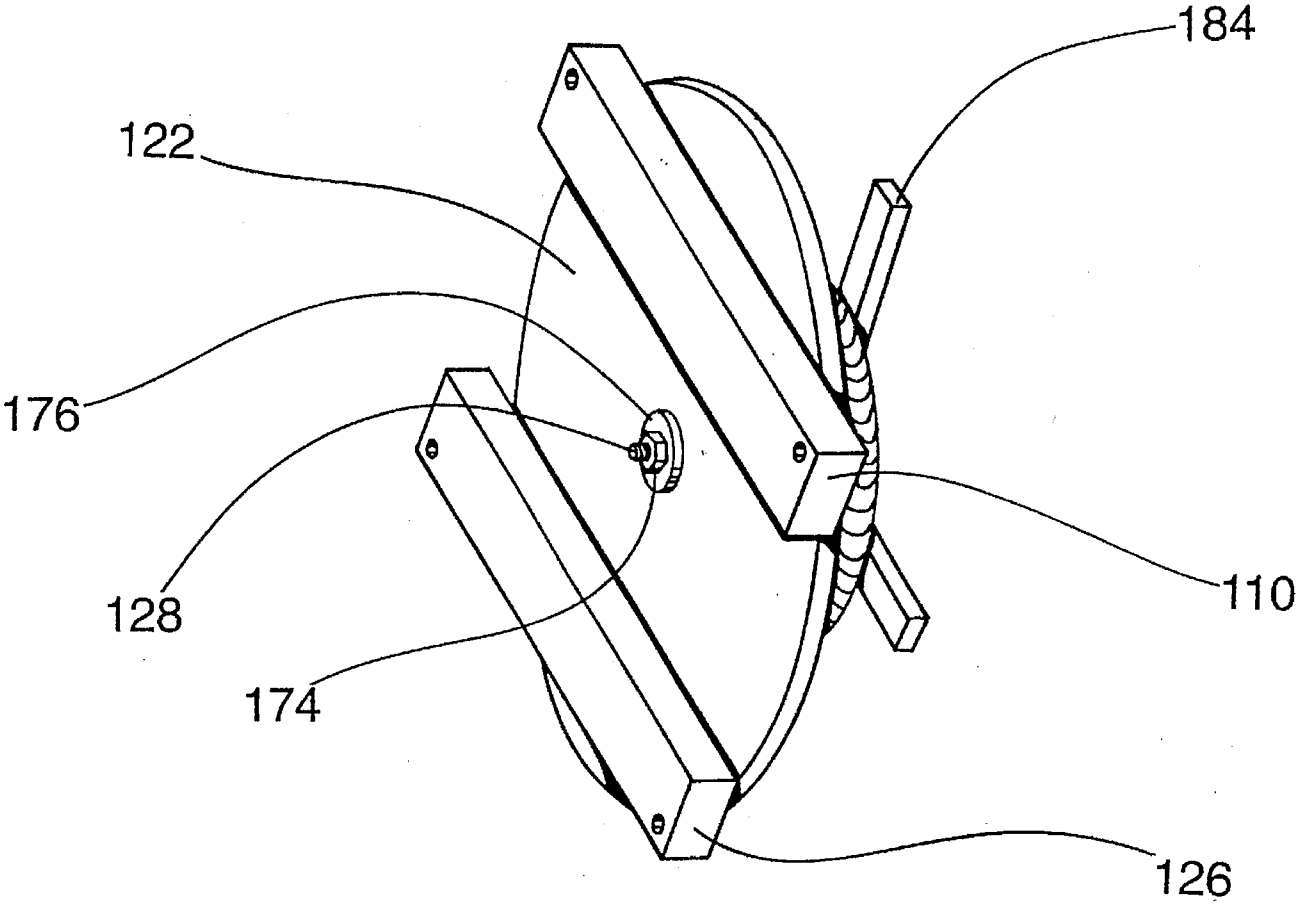
FIG. 8 depicts a perspective, bottom, assembled view of brush rejuvenating apparatus 100, which is a reverse view of FIG. 6.

Referring now to FIG. 7 and FIG. 8, the friction base 122 is mounted on support boards or wall mounts 126. Wall mounts 126 permit hanging of the brush rejuvenating apparatus 100 in an appropriate position on a wall. In this fashion, as the brush 110 dries, it is out of the way.

Centrally located and standardly mounted in the plastic friction base 122 and protruding above the frictional surface 124 is a threaded spindle 128. The threaded spindle 128 receives the brush 110 at the bristles 130. The brush base 132 has mounted oppositely disposed from the bristles 130 a clutch plate 134.

Clutch plate 134 is a standard clutch plate designed to receive the locking plate or primary clutch driver 180. The primary clutch driver 180 meshes with the clutch plate 134 to permit turning of the brush 110, so that the bristles 130 can be held straight. Within the primary clutch driver 180, a substantially triangulated trio of protrusions 136 mesh with the clutch plate 134 and hold the clutch plate 134 in position.

Referring back to FIG. 4, the clutch plate 134, includes a plate aperture 140 for the spindle 128. As the brush 110 and bristles 130 are placed on the frictional surface 124 and the locking plate or primary clutch driver 180 is attached thereto, a torque nut 142 is mounted on the spindle 128. The torque nut 142 is tightened by torque wrench 184 in a standard fashion. This rotation permits the brush bristles 130 to reach a straightened position relative to the brush base 132.

Referring more specifically to FIG. 7 and FIG. 8, wall 116 is shown as having a wall sheet 170 and a wall joist 172 to support the wall sheet 170. To the wall joist 172 and the wall sheet 170 are secured the wall mounts 126 of frictional base 122, by bolts 138.

Threaded spindle 128 is secured in frictional base 122 by lock washer 174 and flat washer 176. Spindle 128 protrudes through the friction base 122 and the frictional surface 124. The brush 110 is then inserted onto frictional surface 124. The clutch plate 134 is then contacted by the locking plate or primary clutch driver 180.

The primary clutch driver 180 has protrusions 136 machined, stamped or otherwise formed therein to cooperate with the clutch plate 134 and permit turning of the brush 110. The torque cradle 182 in the top of primary clutch driver 180 permits the torque wrench, or spinner wrench 184, to lock the primary clutch driver 180 in position. A second torque cradle 182 may also be used if desired. At this point, rubber belt 150 may be secured around the bristles 130 of brush 110.

Figure 9:
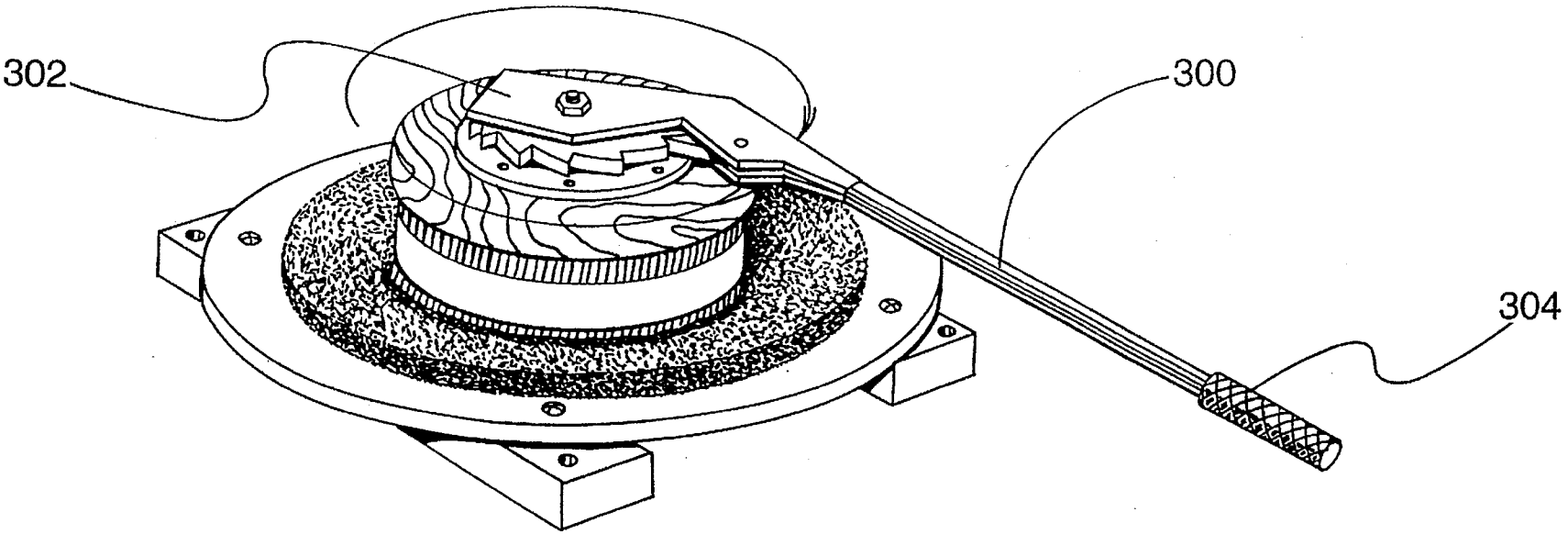
FIG. 9 depicts a partial view of FIG. 4 showing torque wrench 184 replaced with pawl and ratchet grip 300.

In FIG. 9, which replaces the FIG. 4 torque wrench 184 replaced with pawl and ratchet grip 300, another embodiment is shown. The ratchet wrench 302 with pawl and ratchet grip 300 simplifies the assembly of the rejuvenating device 100. The standard reversing lever 304 of the ratchet wrench 302 permits the rejuvenating device 100 to be easily disassembled and brush 110 recovered.

Figure 10:
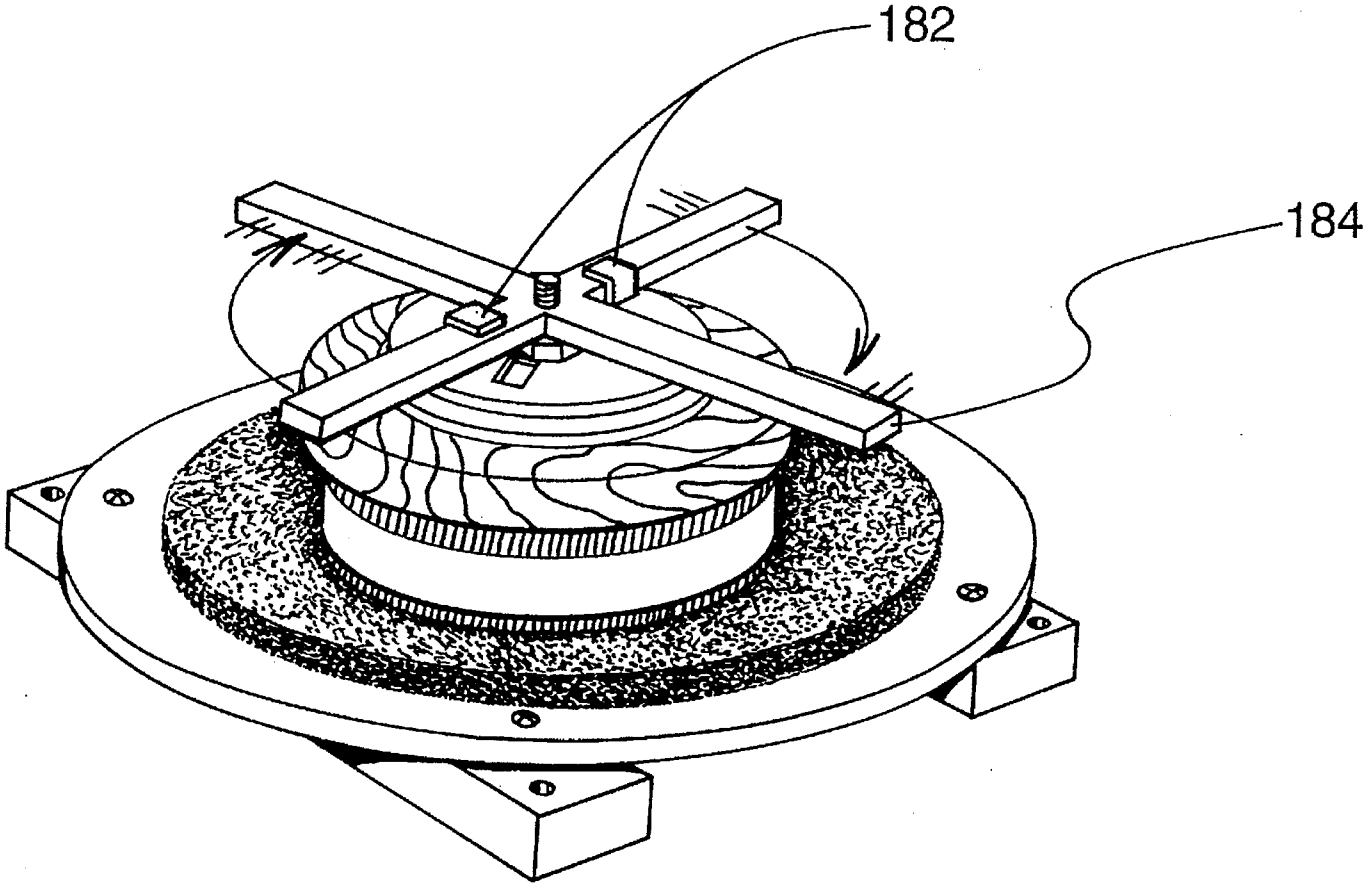
FIG. 10 depicts a second torque cradle 182.

FIG. 10 depicts a second torque cradle 182. This assists torque wrench 184 in its operation. The torque cradle 182 or ratchet wrench 302 provide two preferred examples of assembling rejuvenating device 100.

The following examples are intended to illustrate, without unduly limiting, the scope of this invention.

EXAMPLE ONE

A standard rotary scrubbing machine is used for a daily cleaning machine. A new brush is used on each of even days and odd days. A first brush is used on alternate or even dated days. A second brush is used on the remaining or odd dated days. The first brush is treated with the apparatus of this invention and permitted to dry between uses.

The second brush remains untreated with the apparatus of this invention but is otherwise permitted to dry and be preserved. Over the life of the brush, the second brush, which is untreated, with the straightening process lasts two (2) months. The first brush, which is treated, lasts eight (8) months.

EXAMPLE TWO

In operation, the defective scrub brush bristles are presoaked by immersing them in hot water for up to five minutes and then immediately attaching the brush block to the device as described herein. The primary clutch driver is attached to the clutch plate of the brush block.

While holding the brush block and primary clutch driver, the center hole slowly and carefully slides the primary clutch driver onto the shaft of the threaded spindle with the brush bristles of the brush block contacting the textured surface of the compression plate. A nut slides onto the threaded spindle and is tightened.

Then the rubber compression ring is installed over the brush block so that it contacts and compresses the brush bristles. A lug wrench tightens the square nut by turning in a clockwise direction until the arms of the wrench lock into the slide stops of the primary clutch driver. Then it is tightened further until the brush bristles have reversed the direction that they had previously been bent or flexed. The primary clutch driver is turned with the wrench until the bristles have been slightly flexed beyond the upright position in the opposite direction.

The brush block is then left in this position overnight, or for several hours, depending upon the severity of the flex that the bristles have sustained.

To remove the primary clutch driver, the wrench is turned over so that it contacts the nut from the opposite side to loosen the nut and remove it. The primary clutch driver, the brush block, and the rubber compression ring are then remove in desired order.

The brush bristles are slightly flexed in the opposite direction and ready for use. After such a procedure, the manufacturer's instructions for breaking in a new brush prior to using your brush block must be followed, as the bristles will grab and hold carpeting in the same manner as if it were a new brush block.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An apparatus for rejuvenating a rotary brush in a used condition, the rotary brush including a rotary base, a mounting assembly on a first side of the rotary base and a plurality of bristles on a second side of the rotary base, comprising:

a) a reversing means, a holding means, and a friction means;

b) the holding means supporting the friction means; and c) the reversing means being capable of holding the plurality of bristles against the friction means and reversing the used condition of the rotary brush bristles.

2. The apparatus of claim 1 further comprising:

a) the apparatus being in a fixed position; and b) the holding means being mounted in a permanent position.

3. The apparatus of claim 1 further comprising:

a) the reversing means including a mating means to be removably secured to the mounting assembly;

b) the rotary brush being secured between the reversing means and the friction means; and c) the reversing means including a force means to reverse the bristles of the brush in the used condition; and d) the reversing means being removably secured to the mounting assembly.

4. The apparatus of claim 3 further comprising:

a) the reversing means serving to rotate the rotary brush in a direction reversed from a direction of rotation when the brush is in use;

b) the brush having a new position; and c) the reversing means, the holding means and the friction means combining to hold the bristles in the new position to rejuvenate the brush.

5. The apparatus of claim 4 further comprising:

a) the force means to apply the reversing means being in a clockwise direction; and b) the force means simultaneously compressing the brush bristle against the friction means so as to reverse a counterclockwise flex of the bristles.

6. The apparatus of claim 5 further comprising:

a) the force means including a handle longer than a radius of the brush;

b) the reversing means further including a clamping means to contact the mounting assembly; and c) the reversing means further including a locking means to removably secure the clamping means and thereby hold the brush in the desired position until the bristles dry.

7. The apparatus of claim 6 further comprising:

a) the clamping means being matable with the mounting assembly;

b) the locking means including a nut and a bolt; and c) the bolt being mounted in the holding means.

8. The apparatus of claim 7 further comprising:

a) the clamping means including a torque plate with at least one torque slot thereon; and b) a wrench cooperating with the nut and the at least one torque slot to tighten the nut.

9. The apparatus of claim 8 further comprising the nut being secured to the torque plate.

10. The apparatus of claim 7 further comprising a pawl and ratchet assembly for tightening the nut.

11. The apparatus of claim 7 further comprising the friction means being a buffing pad.

12. A method for rejuvenating a rotary brush in a used condition, the rotary brush including a rotary base, a mounting assembly on a first side of the rotary base and a plurality of bristles on a second side of the rotary base wherein in the used condition the bristles are bent, the method comprising:

a) applying the plurality of bristles to a friction surface;

b) rotating the brush until the plurality of bristles are at least vertical relative to the rotary base;

c) securing the brush to the friction surface; and d) removing the brush from the friction surface.

13. The method of claim 12, further comprising:

a) the bristles of the brush being wet prior to application to the friction surface; and b) allowing the brush to dry after securing the brush to the friction surface and before removing the brush from the friction surface.

* * * * *